United States Patent [19]

Siwik et al.

[11] 4,279,413

[45] Jul. 21, 1981

[54] DRIVE MECHANISMS FOR PASSBOOKS

[75] Inventors: Henry A. Siwik, Plymouth; Lawrence P. Kobylarz, Howell, both of Mich.

[73] Assignee: Burroughs Corporation, Detroit, Mich.

[21] Appl. No.: 85,521

[22] Filed: Oct. 17, 1979

[51] Int. Cl.[3] ..... B65H 5/06

[52] U.S. Cl. ..... 271/274; 400/24; 400/636

[58] Field of Search ..... 271/272–274; 226/187; 400/24–28, 636; 198/624

[56] References Cited

U.S. PATENT DOCUMENTS

| | | | |
|---|---|---|---|
| 1,060,276 | 4/1913 | Moore | 271/274 |
| 2,632,643 | 3/1953 | Egan et al. | 271/274 X |
| 3,005,537 | 10/1961 | Schmeck et al. | 271/273 X |
| 3,211,271 | 10/1965 | Holladay | 400/636 X |
| 3,430,947 | 3/1969 | Davis, Jr. | 271/274 X |
| 3,618,934 | 11/1971 | Germuska | 271/274 |

*Primary Examiner*—Bruce H. Stoner, Jr.
*Attorney, Agent, or Firm*—Delbert P. Warner; Charles E. Quarton; Kevin R. Peterson

[57] ABSTRACT

A flexible drive mechanism for positioning bank passbooks and similar objects is disclosed for use in conjunction with identification and entry posting apparatus. The functioning of the drive mechanism is made flexible by the use of eight rollers, four of which are power driven to serve as drive rollers and four of which are idle rollers. The idle rollers are enabled to move relative to each other and to the drive rollers and are spring biased to firmly engage bank passbooks and similar flat objects and press them against the power drive rollers. The rollers are enabled to accommodate the differences in thickness between parts of the passbooks caused by either the presence of ridges, where sewn seams bind the pages of a book together, or by the presence of difference amounts of paper.

3 Claims, 11 Drawing Figures

DRIVE MECHANISMS FOR PASSBOOKS

BACKGROUND OF THE INVENTION

1. Field of the Invention

The invention relates to mechanisms for handling bank passbooks and the like. It particularly relates to mechanisms of use in receiving and positioning bank passbooks in automatic document identification and posting machines so that the book may be identified and may be updated automatically by having data posted therein.

2. Description of the Prior Art

In the prior art, passbooks have been transported into position for reading and posting by means of rollers which contact the selected front and back faces of each passbook. Pressure from the rollers is used to force the passbook along a path through the mechanism to a desired location. Problems with slippage arise with the prior art devices when an open passbook has different thicknesses at different places. Such differences in thickness occur, for example, when a ridge marking the center of the back of the passbook is parallel to the shaft, or shafts, supporting the rollers and the ridge rides between the rollers. Differences in thickness also occur when the two parts of an open passbook contain different numbers of sheets, as commonly occurs when the book is not open at the exact center. In addition, differences in thickness occur in passbooks from which sheets, or portions of sheets have been torn out by accident or design.

In the prior art, various attempts have been made to prevent slippage and the attendent misalignment. These attempts have included such steps as increasing the force provided by driving motors, using rollers which have surfaces treated to provide greater traction and using bigger rollers. None of these remedies have been entirely satisfactory from a functional standpoint. In addition, they present disadvantages, such as requiring increases in size and the cost of the rollers, driving motors and other driving means as well as presenting greater demands for energy.

SUMMARY OF THE INVENTION

The present invention overcomes the tendency for passbooks to bind between rollers or to skew about an axis which is perpendicular to their line of travel as they go into a reader/printer making identification difficult and causing printed matter to be placed in the wrong places or out of desired alignment. It does so by providing an arrangement of rollers which adapt to ridges and other variations in passbook thickness while still providing the force necessary to move the passbook.

The inventive arrangement of rollers involves the location of a drive roller in tandem with an idle roller for contact with each side of the passbook. The drive roller in contact with one side of the passbook is opposite to an idle roller in contact with the other side of the passbook. The idle rollers are spring biased about the axis of the respective drive roller on the same side to maintain spacing and pressure for the passbook.

Since each of the idle rollers is on a separate shaft and is biased by a separate spacing, the idle rollers operate independently of each other. As a consequence, each idle roller adapts with its corresponding drive roller to securely engage the portion of passbook between it and the drive roller regardless of the thickness of a passbook being processed and regardless of the operation of any other idle roller.

DETAILED DESCRIPTION

Figure 1:
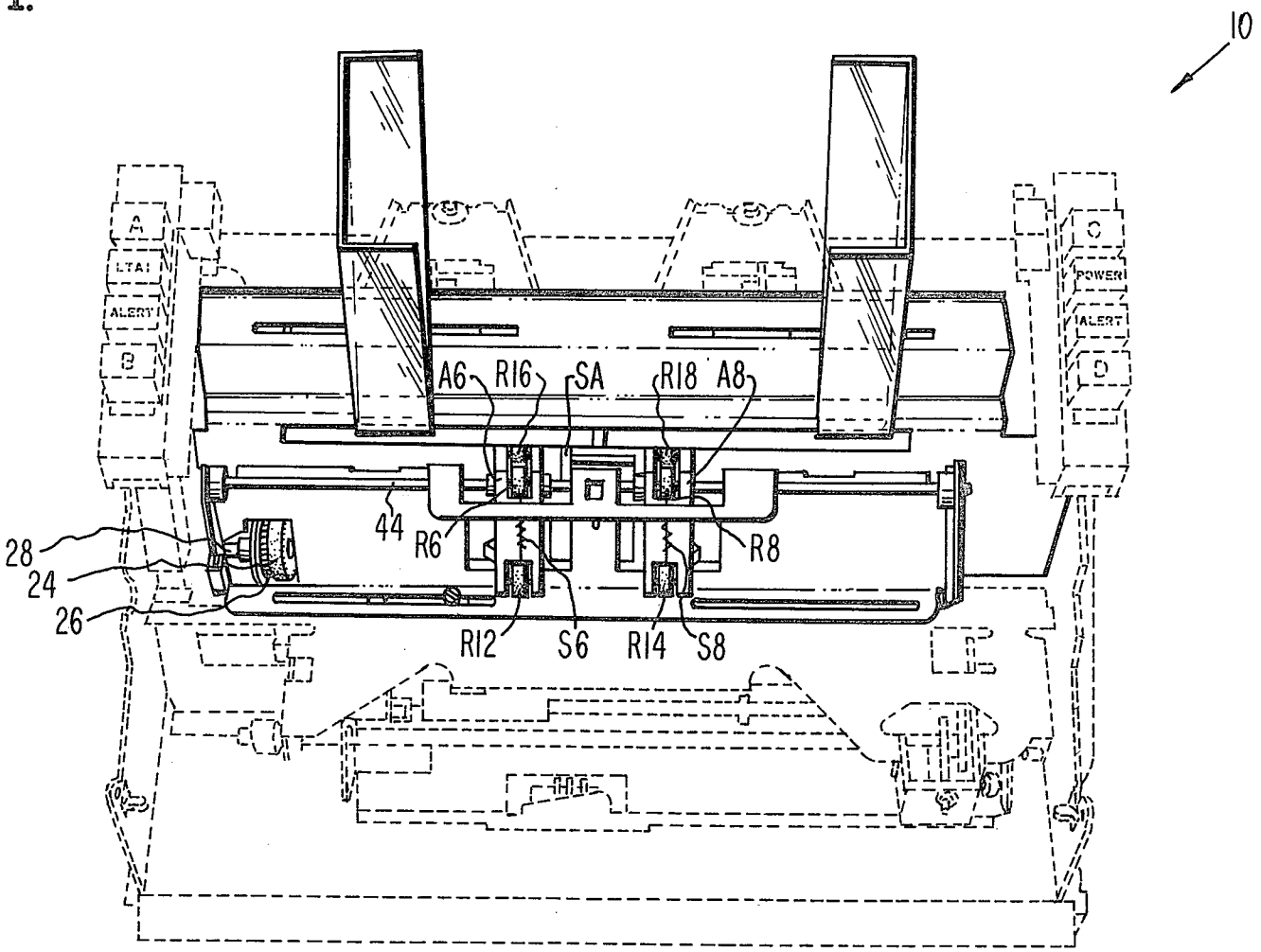
FIG. 1 is a view in solid lines of the front side of a passbook transport mechanism according to the invention showing a view in dashed lines of an exemplary identification and entry posting apparatus.

Turning to FIG. 1, there is shown a perspective view of an embodiment of the invention taken from the front and showing in solid lines how it relates to other elements of a reading and printing machine 10, indicated in outline by dashed lines. When a blank passbook or other document is inserted into the machine, a sensor involving a switch arm SA which operates a switch at SW (FIG. 4) serves to detect the presence of a form and start the machine through interconnections which are not shown.

Figure 2:
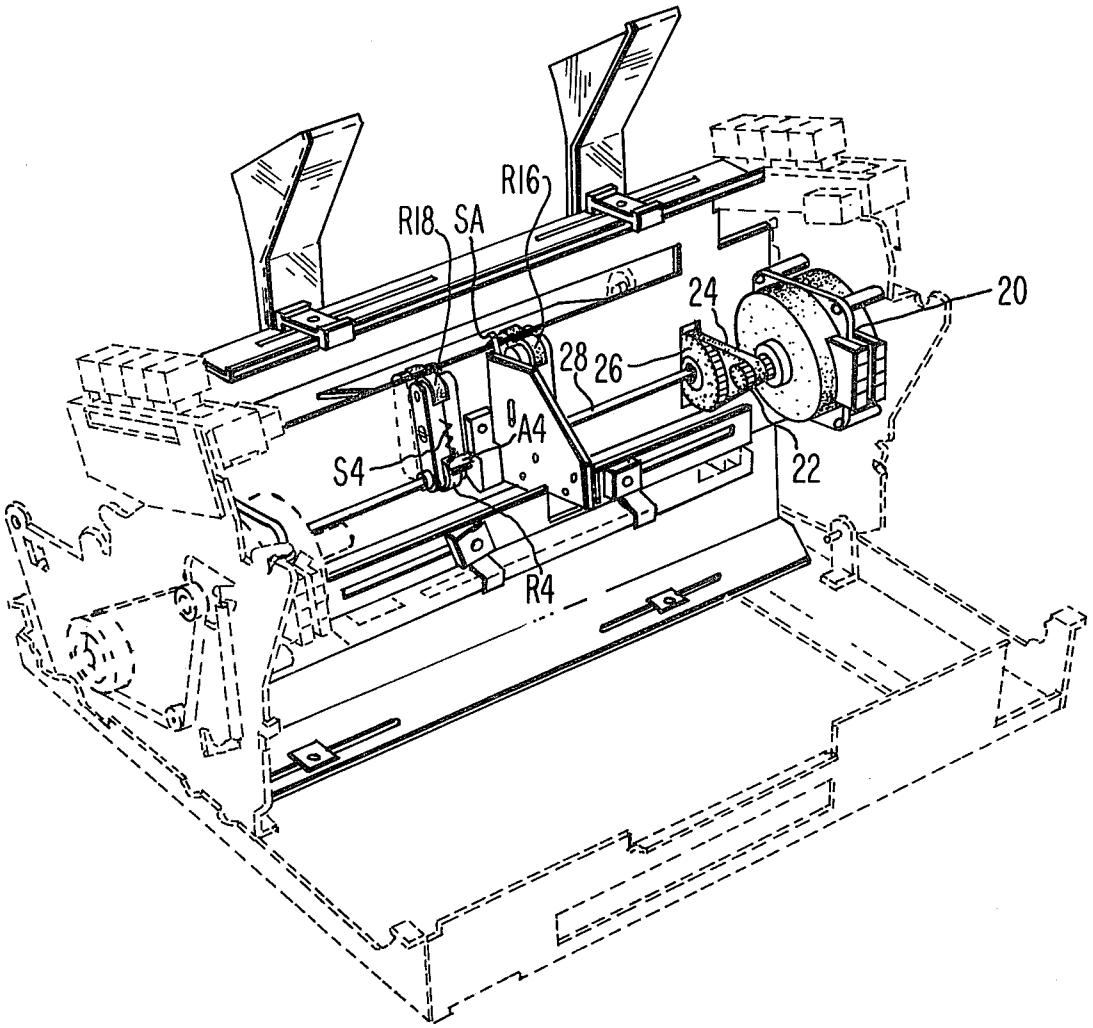
FIG. 2 is a view in solid lines of the reverse side of a passbook transport mechanism according to the invention showing a view in dashed lines of the reverse side of the identification and entry posting apparatus.
Figure 3:
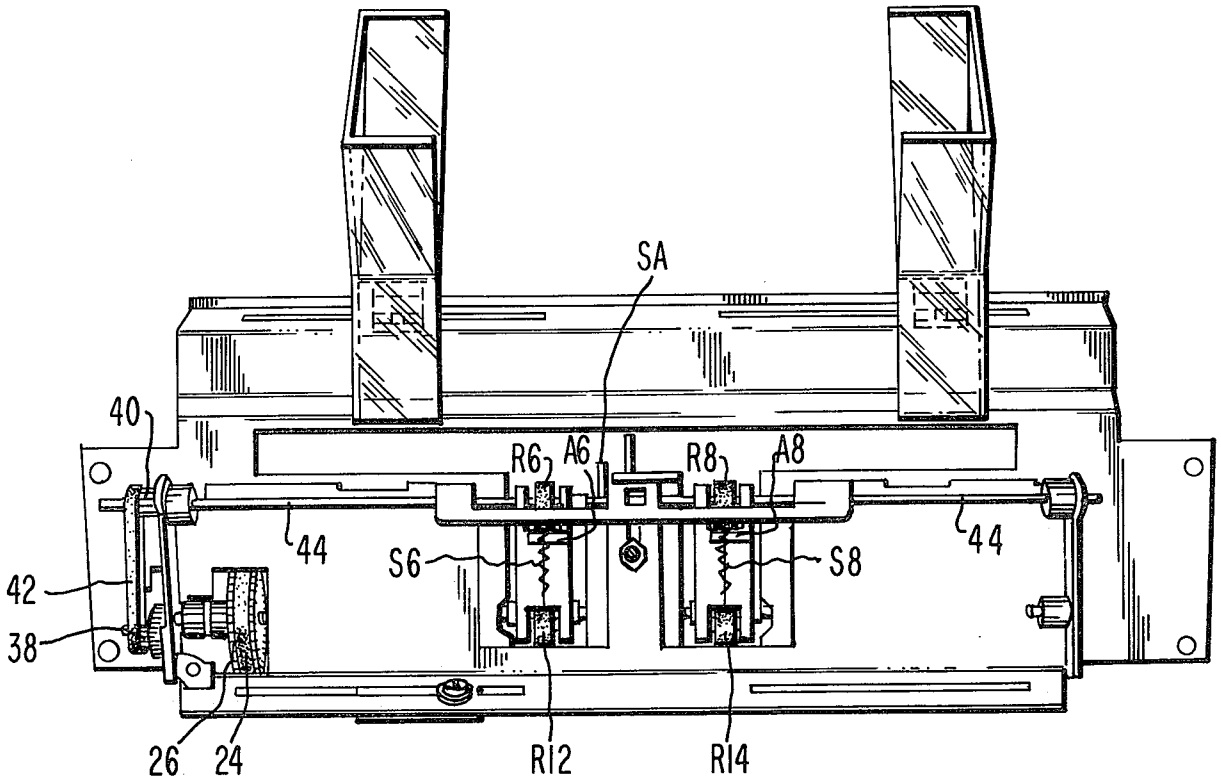
FIG. 3 is a front view of the passbook transport mechanism.
Figure 4:
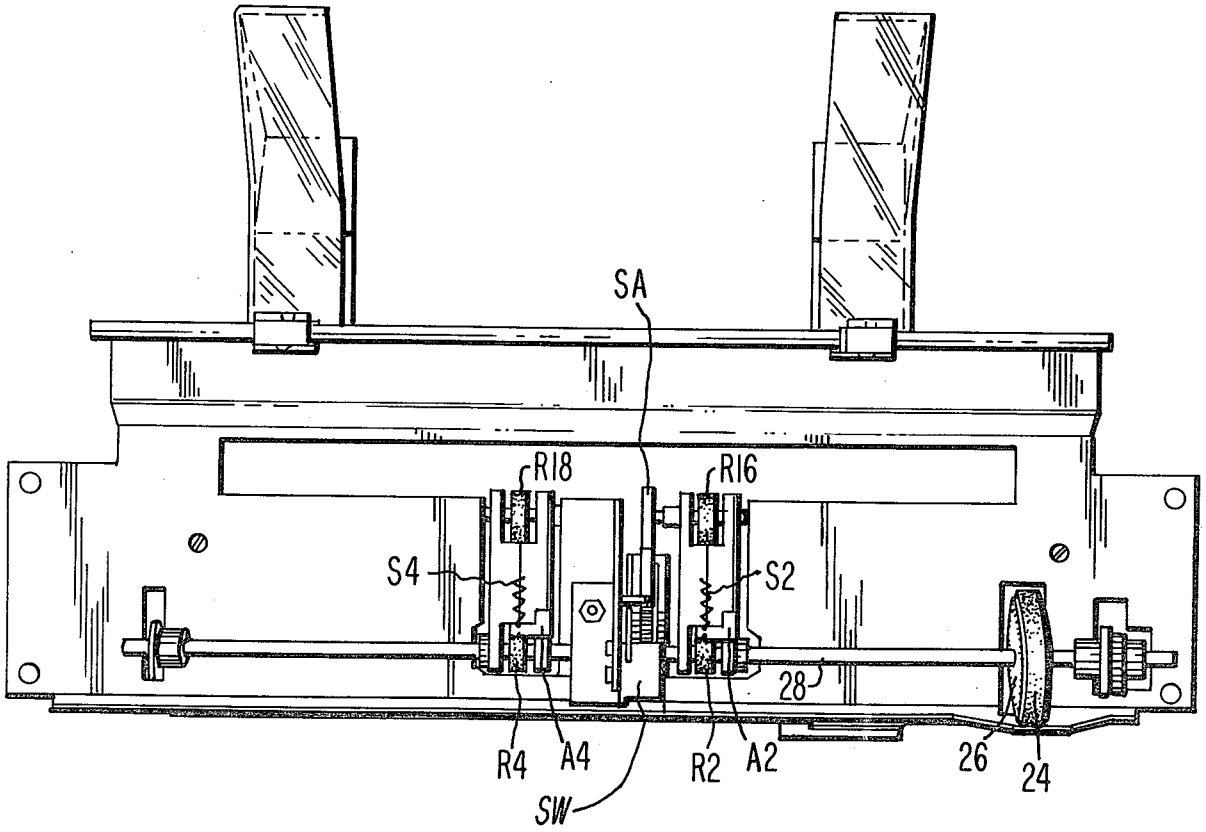
FIG. 4 is a back view of the passbook transport mechanism.

After the machine starts, digital pulses are supplied under control of a microprocessor (not shown) to a stepping motor 20 (FIG. 2) causing the motor to rotate step-by-step. Motor 20 turns a gear 22, to operate a belt 24, a pulley 26, a shaft 28 and rollers, or rolls, R2 and R4. Rolls R2 and R4 are best shown in FIG. 4 and are referred to hereinafter either as drive rolls or drive rollers.

Figure 5:
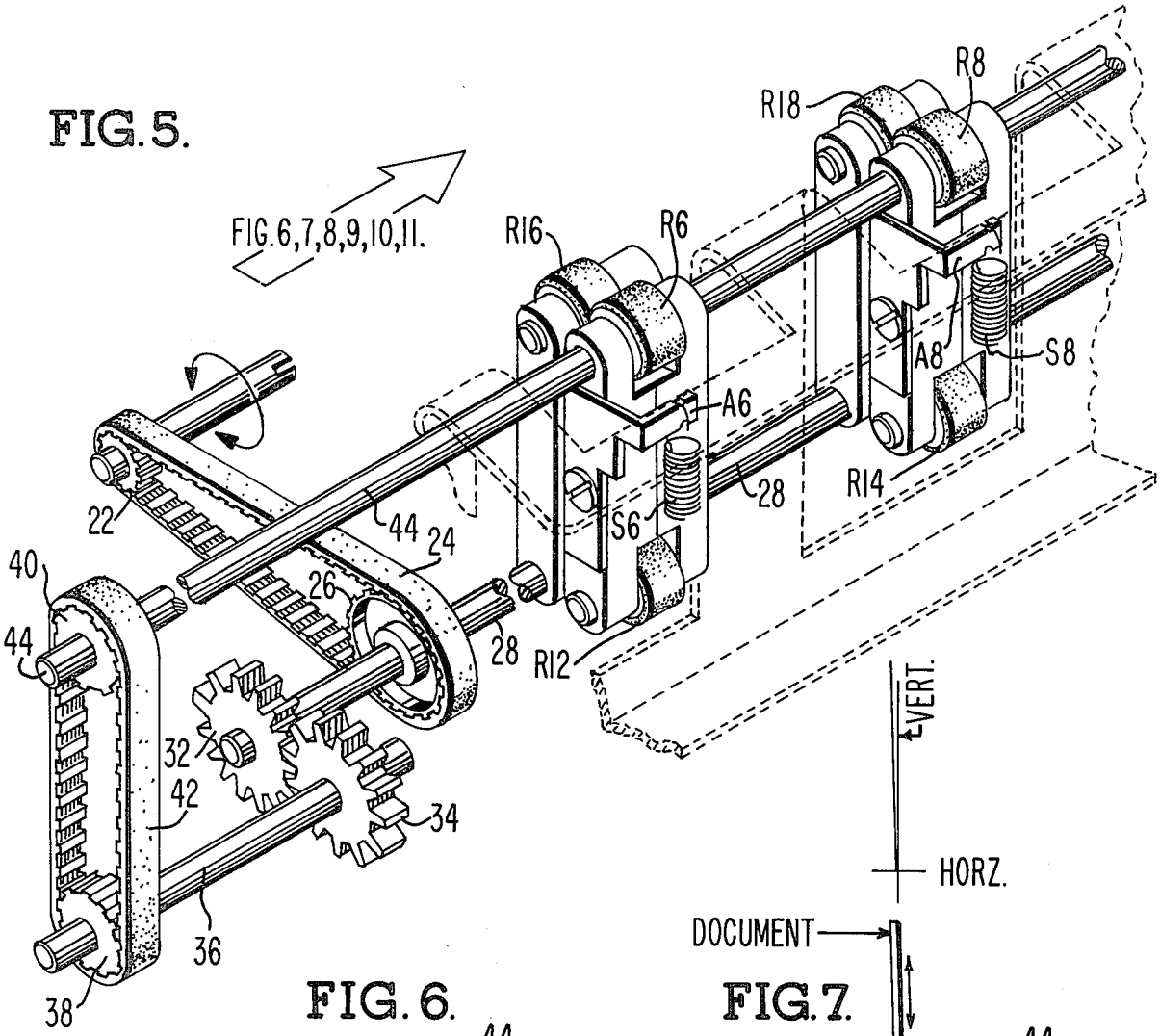
FIG. 5 is a view in perspective of operating mechanical portions of the transport mechanism.

The shaft 28, as is most clearly shown in FIG. 5, operates a gear train including gears 32 and 34 to turn a shaft 36. Shaft 36 drives a linkage formed by gears at 38 and 40 and a belt 42 to turn a shaft 44. Shaft 44 provides a driving force to turn two drive rollers at R6 and R8.

Idler rollers are provided at R12, R14, R16 and R18 in opposition to respective drive rollers R2, R4, R6 and R8. Springs S2, S4, S6 and S8, which are held under tension by means not shown, provide a bias through arms A2, A4, A6 and A8 to urge each of the idle rollers in a direction such that they exert a force against the corresponding drive rollers or against objects positioned between the drive rollers and the idle rollers. Each of the idle rollers is pivoted independently about one of the drive shafts 28 or 44 in such a way that it will be moved away from contact with its related drive roller when passbooks or other objects are inserted between the rollers, and then in cooperation with its respective spring and corresponding drive roller, exert a force on the passbook or other object.

Figure 6:
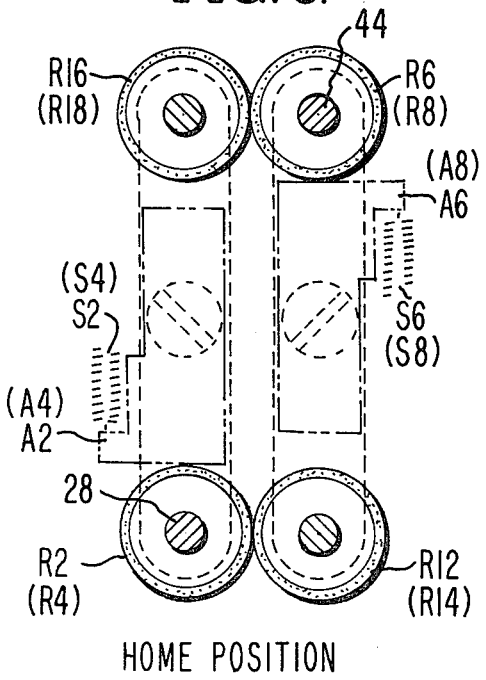
FIG. 6 is a partial view from the left side of the view in FIG. 5, according to the arrow designated FIGS. 6, 7, 8, 9, 10, 11, showing relationships between the various shafts and rollers.

FIG. 6 is a partial view further illustrating the manner in which idle rollers R12 and R16 are biased by springs S2 and S6 in tension with arms A2 and A6 into contact with the respective drive rollers R2 and R6. It will be seen also that corresponding elements which are actually hidden in FIG. 6, and are indicated by parenthesis, function in the same way. Idle rollers R14 and R18, labeled (R14) and (R18), are biased by springs S4 and S8, under tension through arms A4 and A8 and anchors (not shown), into contact with the respective drive rollers R4 and R8.

Figure 7:
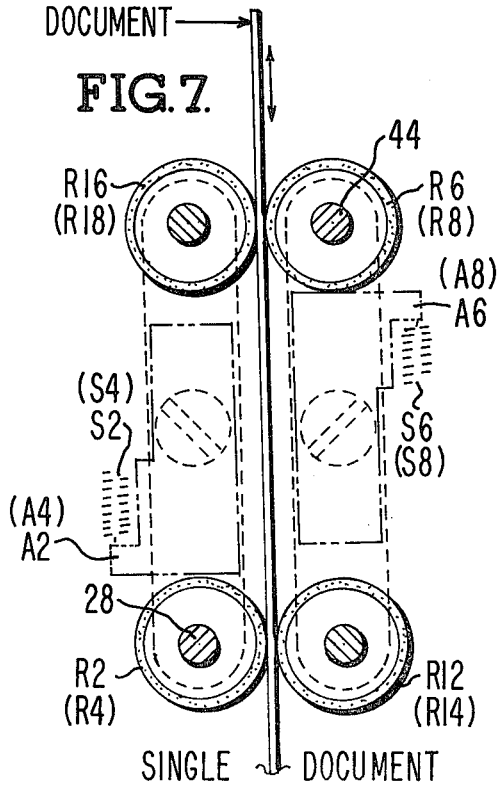
FIG. 7 is a partial view in accordance with FIG. 6 depicting the apparatus with a flat object in position between the rollers.

FIG. 7 is an illustration of the effect of a flat passbook or a card on the configuration of the rolls. Clearly, when the object to be produced is flat, the flexibility inherent in apparatus according to the present invention is not fully utilized.

Figure 8:
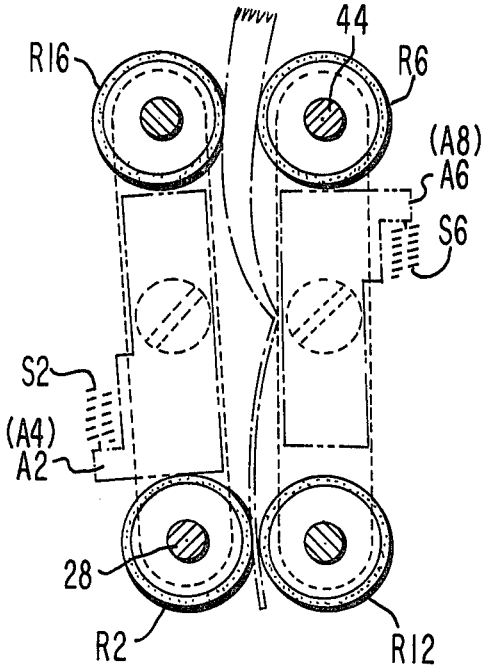
FIG. 8 is a partial view in accordance with FIG. 6 in which an opened passbook having its binder ridge aligned horizontally is shown by dashed lines in position to be drawn through the rollers.

FIG. 8 represents the invention in accordance with FIG. 7 in which a passbook having a ridge along its center, where it is folded and a seam is sewn, is being processed with the seam moving parallel to the rollers. In this example, the force between the visible rollers R2 and R12 and hidden rollers R4 and R14 will be used in conjunction with that between visible rollers R6 and R16 and hidden rollers R8 and R18 to help drive the passbook to a desired position despite the obstacles presented by the horizontal alignment of the ridge.

Figure 9:
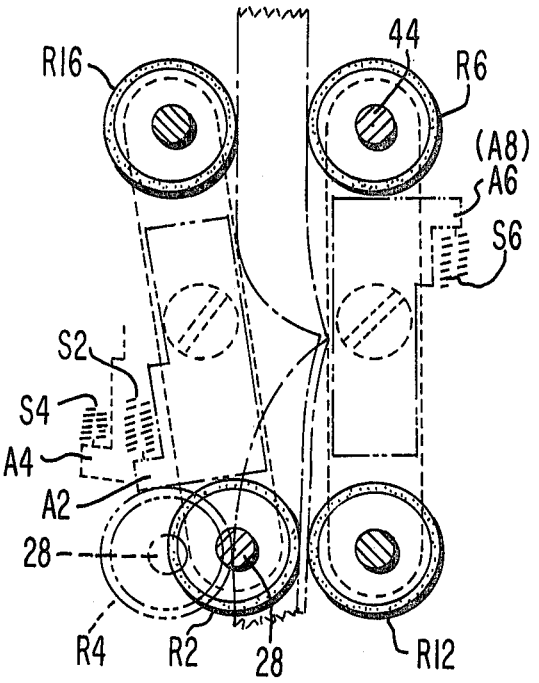
FIG. 9 is a partial view in accordance with FIG. 8 in which a passbook having a number of different thicknesses through different sections is shown by dashed lines in position between the rollers.

FIG. 9 illustrates a situation in which apparatus according to the invention will be able to drive a passbook having sections of unequal thickness in different places. In this case, the passbook is of a single thickness on its upper half and is of two different thicknesses on its lower half. Nevertheless, the present invention is able to exert forces on each part of the book to drive it forward, since the idle rollers are independently arranged to exert forces on each part of the book as it goes between them and the drive rollers.

Figure 10:
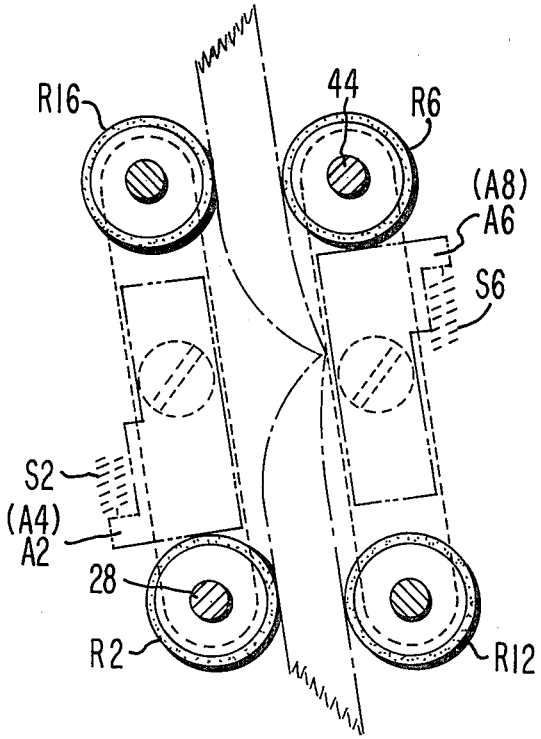
FIG. 10 is a partial view in accordance with FIGS. 8 or 9 in which a passbook, or other bound volume, having an unusually large number of pages is shown by dashed lines to be manageable between rollers aligned according to the present invention.

FIG. 10 illustrates the application of apparatus in accordance with the invention to handling passbooks having greater thickness. It will be seen that all the rollers in this case move apart adequately to receive the thick passbook.

Figure 11:
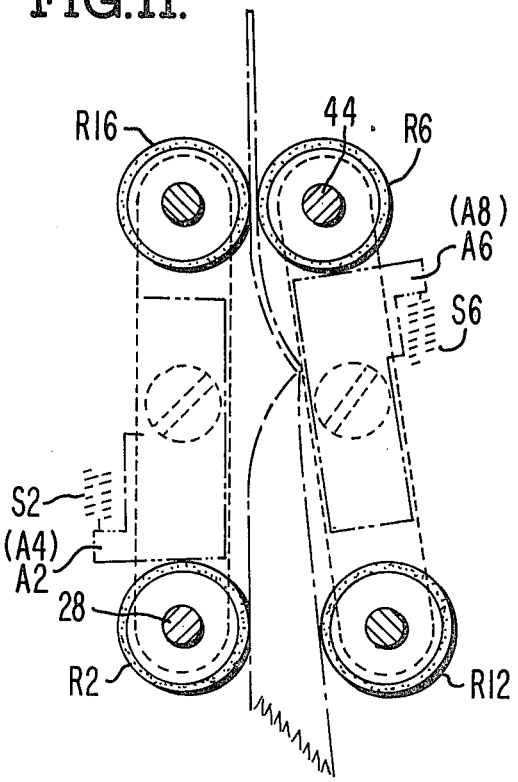
FIG. 11 is a partial view in accordance with FIGS. 8 through 10 in which a passbook having a large number of pages in the first side to contact the rollers is shown midway in passage between the rollers.

The showing in FIG. 11 indicates that a passbook can be handled by embodiments of the invention in which a large end is placed first between the rollers.

The arrangements of FIGS. 8 through 11 work better than known prior art arrangements, which involve rollers on a single pair of fixed axes. A single pair of fixed axes, for example, can only operate on a small part of a passbook, either to pull it as by operation of R2, R4, R12 and R14 or to push it as by operation of R6, R8, R16 and R18. Furthermore, the single pair of axes have involved two rigid shafts which are especially unsuited to handle a load such as that illustrated in FIG. 9. By contrast, with the present inventive arrangement the rollers first contacted, i.e. R6, R16, R8 and R18, grip the leading edges of the passbook securely regardless of variations in thickness of the parts of the passbook and pull it into a position such as shown in FIG. 8 through FIG. 11 without difficulty. Subsequently, from the position shown in FIGS. 8–11, action by the second group of rollers R2, R4, R12 and R14 will forcefully pull the passbook forward while rollers R6, R8, R16 and R18 push the passbook forward thus overcoming the obstacles presented by the ridge in FIG. 8, the sharp step on one side as shown in FIG. 9, the unusually thick passbook of FIG. 10 or the presentation of a thick section to the first set of rollers followed by a thin section as in FIG. 11.

What is claimed is:

1. A drive mechanism for use in transporting bank passbooks and similar objects into position for printing and the like, where the objects are nominally flat but may have uneven thicknesses due to ridges and to the presence of unequal amounts of paper, comprising:

roller means, disposed on opposite sides of a path in a manner enabling a first part of the roller means to engage the leading front and back surfaces of a selected object and to urge the selected object forward to a position enabling a second part of the roller means to engage said front and back surfaces of the selected object;

biasing means cooperating with said roller means to enable each part of said roller means to securely engage opposite surfaces of an object where the surfaces may be separated by different thicknesses of material; and drive means for causing said roller means to rotate and, in cooperation with said biasing means, to transport the object along a selected path between the roller means;

said first part of the roller means including a first pair of drive rollers supported by a first drive shaft coupled to provide driving forces to a surface on a first side of an object to be transported, and a first pair of spring biased idle rollers supported by independent shafts aligned substantially parallel to the drive shaft to engage separate surfaces on the opposite side of an object;

said second part of the roller means including a second pair of drive rollers supported by a second drive shaft to provide driving forces to at least one surface of an object to be transported, and a second pair of spring biased idle rollers having independent shafts aligned substantially parallel to the second drive shaft to engage separate surfaces on the opposite side of an object;

means supporting the first pair of idle rollers on their respective independent shafts to enable them to swing about an axis through the second drive shaft; and means supporting the second pair of idle rollers on their respective independent shafts to enable the second pair of idle rollers to swing about an axis through the first drive shaft.

2. A mechanism for transporting substantially flat objects, such as open bank passbooks, which exhibit differences in thickness due to binder ridges or the presence of different quantities of paper, comprising:

roller means including a first plurality of rollers disposed to mate with opposite faces of a first portion of an object, and a second plurality of rollers disposed to mate with opposite faces of a second portion of an object;

said first plurality of rollers including a first drive roller and a first driven roller;

means supporting said first drive roller in a position opposite to said first driven roller;

said second plurality of rollers including a second drive roller and a second driven roller;

means supporting said second drive roller in a position opposite to said second driven roller;

means biasing said first and second driven rollers separately to cause them to apply pressure to an object positioned between the respective drive and driven rollers;

means coupled to drive said first and second drive rollers to enable transport of an object positioned between said drive and driven rollers, said first plurality of rollers including a first pair of drive rollers supported by a first single shaft and a first pair of driven rollers supported by independent shafts;

the second plurality of rollers including a second pair of drive rollers supported by a second single shaft and a pair of driven rollers supported by independent shafts; and means provided to couple the drive rollers together to turn them synchronously;

a separate arm supporting each of said first driven rollers at one end and engaging the second single shaft at the other to enable rotation of the arm about said other end; and a separate arm supporting each of said second driven rollers at one end and engaging the first single shaft at the other end to enable rotation of the arm about the other end.

3. A drive mechanism for use in transporting bank passbooks and similar objects into position for printing and the like, where the objects are nominally flat but may have uneven thicknesses due to ridges and to the presence of unequal amounts of paper, comprising:

roller means, disposed on opposite sides of a path in a manner enabling a first part of the roller means to engage the leading front and back surfaces of a selected object and to urge the selected object forward to enable a second part of the roller means to engage said front and back surfaces of the selected object;

biasing means cooperating with said roller means to enable each part of said roller means to securely engage opposite surfaces of an object where the surfaces may be separated by different thicknesses of material;

drive means for causing said roller means to rotate and, in cooperation with said biasing means, to transport the object along a selected path between the roller means;

each part of said roller means including drive rollers supported on a drive shaft and idle rollers supported on independent idler shafts by arms which are spring biased independently of each other by separate springs into positions to oppose the drive rollers and provide carriers to transport unequal thicknesses of paper;

a first one of said arms having one end supporting a first idle roller and a second end engaging the drive shaft of a first adjacent drive roller in a manner enabling said first arm and associated idle roller to rotate about the second end of the first arm; and a second one of said arms having one end supporting a second idle roller and a second end engaging the drive shaft of a second adjacent drive roller to enable the second arm and associated idle roller to rotate about the second end of the second arm.

* * * * *